US012226708B2

(12) United States Patent
Che et al.

(10) Patent No.: US 12,226,708 B2
(45) Date of Patent: Feb. 18, 2025

(54) JIGSAW PUZZLE TABLE

(71) Applicant: Xiaoling Che, Hubei (CN)

(72) Inventors: Xiaoling Che, Hubei (CN); Xiaoyi Che, Hubei (CN); Jinyan Duan, Guangdong (CN)

(73) Assignee: Xiaoling Che, Dangyang (CN)

( * ) Notice: Subject to any disclaimer, the term of this patent is extended or adjusted under 35 U.S.C. 154(b) by 0 days.

(21) Appl. No.: 18/740,863

(22) Filed: Jun. 12, 2024

(65) Prior Publication Data

US 2024/0325874 A1 Oct. 3, 2024

Related U.S. Application Data

(63) Continuation-in-part of application No. 18/222,990, filed on Jul. 17, 2023, which is a continuation-in-part of application No. 17/720,682, filed on Apr. 14, 2022, and a continuation-in-part of application No. 29/824,951, filed on Jan. 28, 2022, now Pat. No. Des. 1,009,177, and a continuation-in-part of application No. 29/818,457, filed on Dec. 9, 2021, now Pat. No. Des. 1,029,113, and a continuation-in-part of (Continued)

(30) Foreign Application Priority Data

| | | |
|---|---|---|
| Jan. 28, 2022 | (CN) | 202210103787.9 |
| Oct. 28, 2022 | (CN) | 202230717091.6 |
| May 8, 2024 | (CN) | 202420991164.4 |

(51) Int. Cl.

| | |
|---|---|
| ***A63F 9/10*** | (2006.01) |
| ***A47B 9/20*** | (2006.01) |
| ***A47B 13/08*** | (2006.01) |
| ***A47B 25/00*** | (2006.01) |

(52) U.S. Cl.

CPC ..... *A63F 9/1044* (2013.01); *A47B 9/20* (2013.01); *A47B 13/081* (2013.01); *A47B 25/00* (2013.01); *A47B 2200/0043* (2013.01); *A47B 2200/0052* (2013.01); *A63F 2009/105* (2013.01)

(58) Field of Classification Search

CPC .. A63F 9/1044; A63F 2009/105; A47B 25/00; A47B 23/042

USPC ..... 108/5, 59, 10

See application file for complete search history.

(56) References Cited

U.S. PATENT DOCUMENTS

| | | | | |
|---|---|---|---|---|
| 129,870 A * | 7/1872 | Stahn | ..... | A47B 27/02 108/10 |
| 702,749 A * | 6/1902 | Smith | ..... | A47B 27/02 108/10 |

(Continued)

*Primary Examiner* — Jose V Chen

(57) ABSTRACT

A jigsaw puzzle table includes: a puzzle board; a board bracket, wherein the puzzle board is mounted on a mounting end of the board bracket; a lower support, wherein the board bracket is mounted between the puzzle board and the lower support, the board bracket and the lower support are configured to support the puzzle board, the board bracket and the lower support are movably connected to each other; and a positioning fastener, connected to at least one of the board bracket and the lower support. The positioning fastener is configured to secure the board bracket and the lower support to fix a height of the puzzle board. The positioning fastener is further configured to release the security between the board bracket and the lower support to enable the board bracket and the lower support to be at least partially movable to adjust the supported height.

19 Claims, 13 Drawing Sheets

Related U.S. Application Data application No. 29/859,220, filed on Nov. 8, 2022, now Pat. No. Des. 1,004,709.

(56) References Cited

U.S. PATENT DOCUMENTS 922,565 A * 5/1909 Cole ..... A47B 27/00 211/12
1,203,659 A * 11/1916 Smith ..... A47B 23/043 248/456
2,708,808 A * 5/1955 Simpson ..... A47B 19/06 312/316
3,026,158 A * 3/1962 Freeman ..... A47B 5/04 108/134
3,123,935 A * 3/1964 Williams ..... A47B 13/16 248/500
3,125,971 A * 3/1964 Wetherill ..... A47B 25/00 108/125
3,682,109 A * 8/1972 Gordon ..... A47B 13/081 108/9
3,773,154 A * 11/1973 Mitchell ..... A47B 23/043 248/455
D249,532 S * 9/1978 Cudahy, III ..... D19/113
4,312,507 A * 1/1982 Smith ..... A63F 3/0023 273/287
4,865,325 A * 9/1989 Stolz ..... A63F 9/1044 273/157 R
5,529,173 A * 6/1996 Salacuse ..... B65D 75/22 206/315.1
D400,600 S * 11/1998 Ackerman ..... D21/478
6,045,108 A * 4/2000 Cziraky ..... A45C 9/00 248/461
7,073,449 B2 * 7/2006 Pipkin ..... B64D 11/0638 108/9
7,552,821 B1 * 6/2009 Demers ..... A63F 9/1044 206/499
8,322,290 B1 * 12/2012 Mignano ..... A47B 23/043 248/456
8,910,838 B2 * 12/2014 Palmer ..... A47B 23/002 108/43
9,044,688 B1 * 6/2015 Janay ..... B65D 25/22
9,468,290 B2 * 10/2016 Roth ..... A47B 19/06
D977,025 S * 1/2023 Fan ..... D3/297
2011/0056412 A1 * 3/2011 Grammer ..... A45C 9/00 108/1
2021/0170268 A1 * 6/2021 Malki ..... A63F 9/1044
2023/0097737 A1 * 3/2023 Che ..... A47B 13/081 108/1

* cited by examiner

JIGSAW PUZZLE TABLE

CROSS REFERENCE TO RELATED APPLICATIONS

The present application is a continuation-in-part of the U.S. application Ser. No. 18/222,990, filed on Jul. 17, 2023.

The U.S. application Ser. No. 18/222,990 is a continuation-in-part application of the U.S. application Ser. No. 17/720,682, filed on Apr. 14, 2022, which claims the priority of the Chinese patent application No. CN202210103787.9, filed on Jan. 28, 2022.

The U.S. application Ser. No. 18/222,990 is a continuation-in-part application of the U.S. application Ser. No. 29/824,951, filed on Jan. 28, 2022.

The U.S. application Ser. No. 18/222,990 is a continuation-in-part application of the U.S. application Ser. No. 29/818,457, filed on Dec. 9, 2021.

The U.S. application Ser. No. 18/222,990 is a continuation-in-part of the US application No. U.S. Ser. No. 29/859,220, filed on Nov. 8, 2022, which claims priority of the Chinese patent application No. CN202230717091.6, filed on Oct. 28, 2022.

Furthermore, the present application claims the foreign priority of the Chinese patent application No. 202420991164.4, filed on May 8, 2024, contents of which are incorporated herein by its entireties.

TECHNICAL FIELD

The present disclosure relates to the field of puzzle game accessories, and in particular to a jigsaw puzzle table.

BACKGROUND

The jigsaw puzzle, as a puzzle game, is essential in intellectual development for children. Due to the jigsaw puzzle being interesting, the jigsaw puzzle is also popular among adults. When playing the jigsaw puzzle, a player needs to carefully identify puzzle pieces to find similarities between the puzzle pieces to splice the puzzle pieces together. In order to enable the player to splice the puzzle pieces, the jigsaw puzzle table is released to the market. However, the jigsaw puzzle table in the art has a fixed height, and the height cannot be adjusted according to a height of the player. Therefore, the player whose height does not match the height of the jigsaw puzzle table may not use the jigsaw puzzle table comfortably, having a poor usage experience.

SUMMARY OF THE DISCLOSURE

The present disclosure provides a jigsaw puzzle table, including: a puzzle board; a board bracket, wherein the puzzle board is mounted on a mounting end of the board bracket; a lower support, wherein the board bracket is mounted between the puzzle board and the lower support, the board bracket and the lower support are configured to support the puzzle board cooperatively, the board bracket and the lower support are movably connected to each other; a positioning fastener, connected to at least one of the board bracket and the lower support, wherein the positioning fastener is configured to secure the board bracket and the lower support to fix a height of the puzzle board supported by the board bracket and the lower support; the positioning fastener is further configured to release the security between the board bracket and the lower support to enable the board bracket and the lower support to be at least partially movable relative to each other to adjust the supported height.

DETAILED DESCRIPTION

Figure 1:
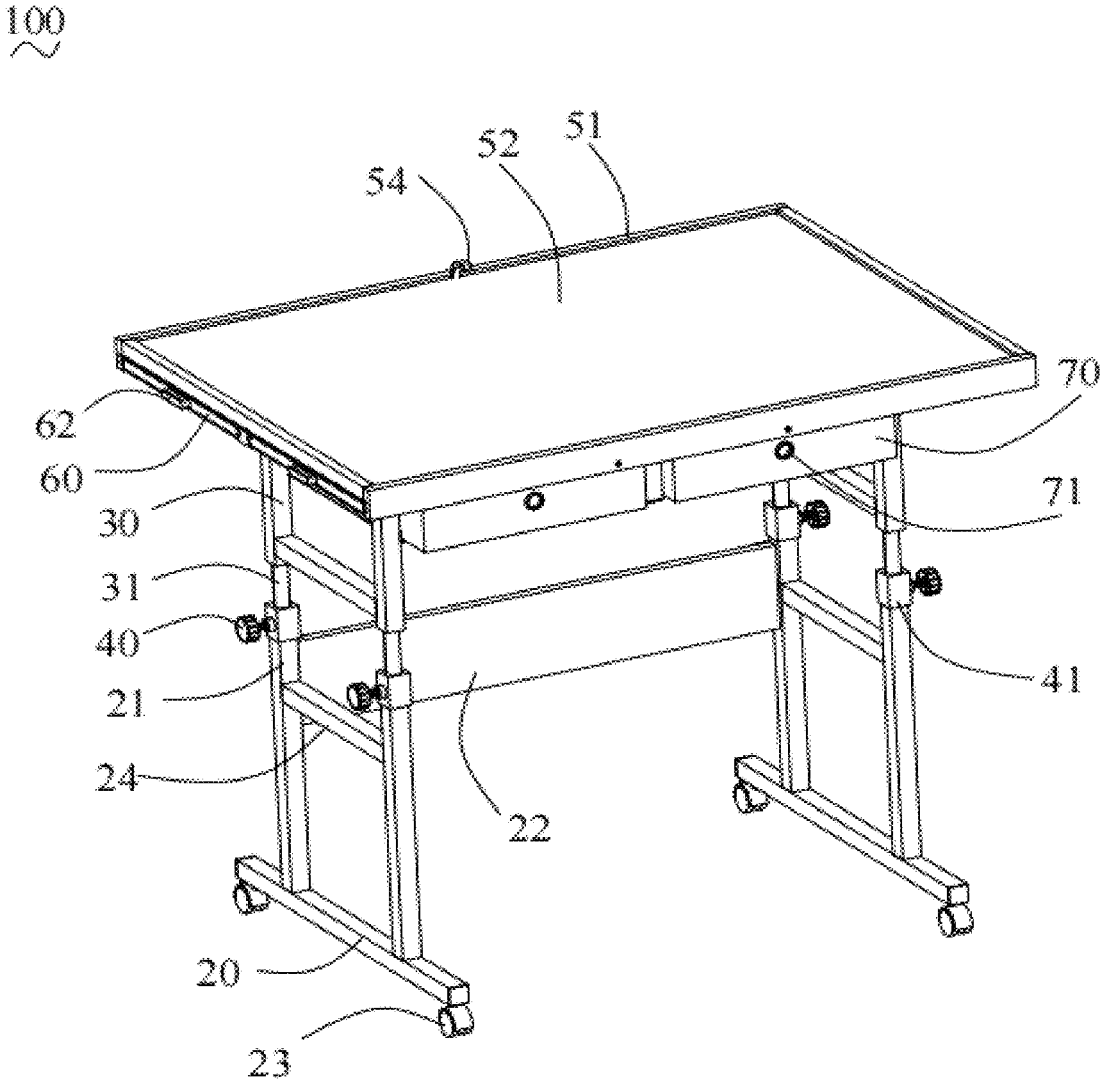
FIG. 1 is a schematic view of a jigsaw puzzle table according to an embodiment of the present disclosure.
Figure 2:
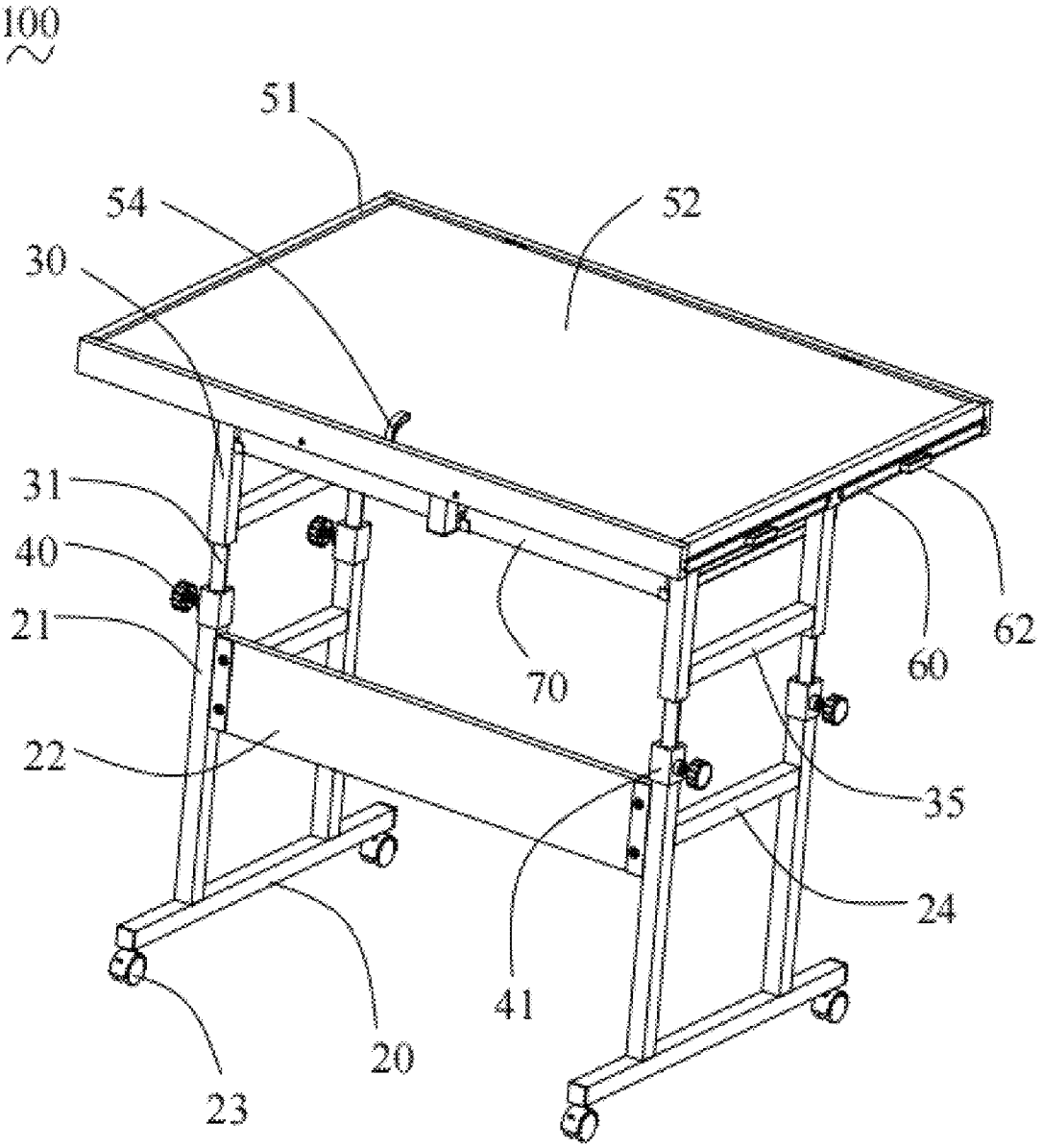
FIG. 2 is a schematic view of the jigsaw puzzle table, being viewed from another viewing angle, according to an embodiment of the present disclosure.

In order to facilitate understanding of the present disclosure, the present disclosure will be fully described below by referring to the accompanying drawings. The accompanying drawings show preferred embodiments of the present disclosure. However, the present disclosure can be realized in various forms, which are not limited to the embodiments described herein. The embodiments are provided to enable the present disclosure to be understood more thoroughly and comprehensively.

It should be noted that when an element is "fixed" to another element, it means that the element is directly arranged on the another element, or an intermediate element is arranged therebetween. When an element is "connected" to another element, it means that the element is directly connected to the another element, or an intermediate element is arranged therebetween. Furthermore, the term "and/or" is merely a description of an associative relationship between associated objects and indicates that three relationships may exist. For example, A and/or B means that A exists alone, both A and B exist, and B exists alone.

Unless otherwise defined, all technical and scientific terms used herein have the same meaning as commonly understood by any ordinary skilled person in the art. Terms in the specification of the present disclosure are used only for the illustrative purposes only. For example, "in," "out,"

"left," "right," and similar expressions are used for illustrative purposes only, and are not intended to limit the present disclosure.

As shown in FIGS. 1 to 13, schematic views of the jigsaw puzzle table 100 are shown. The jigsaw puzzle table 100 includes a lower support 20, a board bracket 30, and a puzzle board 50. The puzzle board 50 is mounted at a mounting end of the board bracket 30. The board bracket 30 is mounted between the puzzle board 50 and the lower support 20. The lower support 20 and the board bracket 30 cooperatively support the puzzle board 50. The lower support 20 and the board bracket 30 are movably connected to each other adjust a support height on at least one side.

According to the puzzle table 100 of the present embodiment, the height of at least a portion of the puzzle table 50, which is supported by the lower support 20 and the board bracket 30 cooperatively, is adjusted by movably connecting the lower support 20 with the board bracket 30, such that the adjusted height meets demands of various users or meets various demands of a same user.

It should be understood that, in the present embodiment, the movable connection between the lower support 20 and the board bracket 30 to adjust the support height on at least one side of the puzzle board 50 means that the movable connection between the lower support 20 and the board bracket 30 adjusts the height of at least a portion of the puzzle board 50 which is supported by the lower support 20 and the board bracket 30.

In a first case, an overall of the lower support 20 and the board bracket 30 is movable. For example, the lower support 20 and the board bracket 30 can be displaced, such that an overall height of the puzzle board 50 supported by the lower support 20 and the board bracket 30 is adjusted. The entire puzzle board 50 may be adjusted from a first position to a second position. The first position and the second position are used to represent a change in position of the entire puzzle board 50.

In a second case, a first side of the lower support 20 is connected to a first side of the board bracket 30, and a second side of the lower support 20 is connected to a second side of the board bracket 30. The first side of the board bracket 30 supports a first portion of the puzzle board 50, and the second side of the board bracket 30 supports a second portion of the puzzle board 50. The first portion and the second portion of the puzzle board 50 may refer to portions near edges of the puzzle board 50 in a length direction of the puzzle board 50. A common side of the lower support 20 and the board bracket 30, i.e., either the first side or the second side thereof, is movable. For example, the first side thereof may be displaced, such that the height of the first portion of the puzzle board 50 supported by the first side of the lower support 20 and the first side of the board bracket 30 is adjusted, and the height of the second portion of the puzzle board 50 supported by the second side of the lower support 20 and the second side of the board bracket 30 is unchanged. In this way, the puzzle board 50 is changed from a first state to a second state. It should be understood that the first state is different from the second state. In the present disclosure, a support surface is defined, for example, the support surface refers to a surface on which the puzzle board 50 is placed. The support surface may be substantially parallel to a horizontal plane. Exemplarily, in the first state, the puzzle board 50 is substantially parallel to the support surface. In other words, the puzzle board 50 is substantially horizontally placed. In the second state, the puzzle board 50 is inclined with respect to the support surface, i.e., the puzzle board 50 is in an inclined state.

In a third case, at least one of the lower support 20 and the board bracket 30 has at least two sub-portions, and the puzzle board 50 has at least two sub-portions. One sub-portion of the at least two sub-portions of the lower support 20, one sub-portion of the at least two sub-portions of the board bracket 30, and one sub-portion of the at least two sub-portions of the puzzle board 50 are connected to each other correspondingly. At least one sub-portion of the lower support 20 is movably connected to the at least one sub-portion of the board bracket 30 to adjust the height of at least one sub-portion of the puzzle board 50. In an example, a first sub-portion of the lower support 20 is movably connected to a second sub-portion of the board bracket 30 to adjust a height of a third sub-portion of the puzzle board 50.

The movable connection between the lower support 20 and the board bracket 30 includes, but is not limited to, any one of sliding-sleeving connection, threaded connection, telescopic-driving connection, and splicing connection. The embodiments of the present disclosure will be illustrated by taking the sliding-sleeving connection between the lower support 20 and the board bracket 30 as an example. Exemplarily, a portion of one of the lower support 20 and the board bracket 30 can be inserted into the other one of the lower support 20 and the board bracket 30. In this way, sleeving connection between the lower support 20 and the board bracket 30 is achieved. In addition, the lower support 20 and the board bracket 30 can slide with respect to each other, such that the movable connection between the lower support 20 and the board bracket 30 is achieved. Therefore, the height of the puzzle board 50 supported by the lower support 20 and the board bracket 30 is adjusted.

It is to be understood that the sleeving connection between the lower support 20 and the board bracket 30 increases stability of the connection therebetween, the lower support 20 and the board bracket 30 are prevented from wobbling, such that stability of the jigsaw puzzle table 100 is improved.

To be noted that, at least a portion, such as at least one side (at least one of the first side and the second side), of the lower support 20 and the board bracket 30 of the present disclosure can be displaced. For example, the lower support 20 and the board bracket 30 are slidable relative to each other. In practice, when the height of the puzzle board 50 supported by the lower support 20 and the board bracket 30 reaches a height desired by the user, the lower support 20 and the board bracket 30 are fastened to each other. Fastening between the lower support 20 and the board bracket 30 may be realized by the structures arranged on the lower support 20 and the board bracket 30 or by additional elements.

Exemplarily, the puzzle table 100 further includes a positioning fastener 40, the positioning fastener 40 is connected to at least one of the lower support 20 and the board bracket 30. The positioning fastener 40 is configured to secure the lower support 20 and the board bracket 30 to fix the height of puzzle board 50 supported by the lower support 20 and the board bracket 30. The positioning fastener 40 is configured to release the fastening between the lower support 20 and the board bracket 30 to enable the lower support 20 and the board bracket 30 to at least partially move with respect to each other to adjust the support height of the puzzle board 50.

In the present embodiment, the movable connection is the sliding-sleeving connection. The jigsaw puzzle table 100 includes: the lower support 20; the board bracket 30 that is slidably and sleevingly connected to the lower support 20; the positioning fastener 40 that is mounted on the lower support 20 and is opposite to the board bracket 30; and the puzzle board 50 mounted on the board bracket 30. The board bracket 30 may be lifted up or lowered down along the lower support 20.

Exemplarily, the lower support 20 has four support tubes 21. The board bracket 30 has four support rods 31. One end of each support rod 31 is sleeved inside a respective one support tube 21. In this way, the board bracket 30 and the lower support 20 are guided to be assembled to each other at four points, such that stability of the support is improved. Further, the lower support 20 is arranged with a reinforcing plate 22, and the reinforcing plate 22 is configured to improve overall structural strength of the lower support 20.

As shown in FIGS. 6 to 9, in the present embodiment, the jigsaw puzzle table 100 further includes a sleeve tube 41 that sleeves the support tube 21 and the support rod 31. The positioning fastener 40 is connected to the sleeve tube. The sleeve tube 41 is configured to adjust a relative positional relationship, or a connection relationship or a distance relationship, between the support tube 21 and the support rod 31, such that the height that the support tube 21 and the support rod 31 support the puzzle board 50 is adjusted.

Exemplarily, after the sleeve tube 41 sleeves the support tube 21 and the support rod 31, the sleeve tube 41 is fastened to the support tube 21 and/or the support rod 31 by the positioning fastener 40, such that the support tube 21 and the support rod 31 are positioned. It should be understood that the positioning fastener 40 can disconnect the sleeve tube 41 from the support tube 21 and/or the support rod 31, such that the relative positional relationship between both the support tube 21 and the support rod 31 is adjusted.

Exemplarily, the positioning fastener 40 includes a fastening portion 401 and an operating portion 402. The fastening portion 401 is connected to the operating portion 402. The fastening portion 401 protrudes from an end face of the operating portion 402. The fastening portion 401 is connected to at least the sleeve tube 41. Exemplarily, the sleeve tube 41 defines a fastening hole 43. The fastening portion 401 can be received in and detached from the fastening hole 43.

In order to increase stability of connection between the fastening portion 401 and the sleeve tube 41. A reinforcing member 44 is arranged on an outer surface of the sleeve tube 41. The reinforcing member 44 is arranged around the fastening hole 43. The fastening portion 401 passes through the reinforcing member 44 to be connected to the sleeve tube 41. The reinforcing member 44 can be connected to the sleeve tube 41 by bonding or welding, or the reinforcing member 44 and the sleeve tube 41 are integrally molded to form a one-piece structure. The reinforcing member 44 increases a connection area between the fastening portion 401 and sleeve tube 41, and therefore, stability of the connection therebetween is improved.

The connection between the fastening portion 401, the sleeve tube 41, and the reinforcement member 44 includes, but is not limited to, threaded connection and snap connection. The embodiments of the present disclosure will be illustrated by taking the threaded connection between the fastening portion 401, the sleeve tube 41, and the reinforcing member 44 as an example. In this way, connection and separation therebetween can be achieved easily.

The operating portion 402 is operated by a finger of the user or by a tool. Exemplarily, a non-slip element or an operating element for operation by the tool is arranged around a circumference of the operating portion 402. To be noted that the structure of the positioning fastener 40 and the connection between the positioning fastener 40 and the sleeve tube 41 are not limited the present disclosure.

Exemplarily, the support rod 31 and the support tube 21 are connected to each other in a sleeved manner. For example, the support rod 31 can be inserted into the support tube 21 and is movable, such as slidable, inside the support tube 21. Exemplarily, the support tube 21 defines a receiving channel 211. The support rod 31 is received in the receiving channel 211 and is movable in the receiving channel 211. It should be understood that the support rod 31 passes through the sleeve tube 41 firstly, and subsequently, inserted into the receiving channel 211. In the present embodiment, the sleeve tube 41 is hollow, ensuring that the support rod 31 passes through the sleeve tube 41. The sleeve tube 41 defines a tube channel 42.

To be noted that a depth of the receiving channel 211 may be determined according to the actual needs, which will not be limited herein.

Exemplarily, the sleeve tube 41 defines a first channel 421 and a second channel 422 communicated with the first channel 421. A shape of the first channel 421 is adapted to a shape of an outer surface of the support rod 31, and a shape of the second channel 422 is adapted to a shape of an outer surface of the support tube 21.

It should be understood that the first channel 421 and the second channel 422 enables the sleeve tube 41 to be hollow. A size of the second channel 422 is not smaller than a size of the first channel 421. The second channel 422 allows the support rod 31 to pass through. Exemplarily, the size of the second channel 422 is greater than the size of the first channel 421. An outer periphery of the support tube 21 is larger than the size of the first channel 421. After the sleeve tube 41 sleeves the support tube 21, the support tube 21 is restricted in the second channel 422 and is prevented from extending into the first channel 421.

Exemplarily, a cross section of the support rod 31 is circular, a cross section of the support tube 21 is square, the first channel 421 is a circular channel, and the second channel 422 is a square channel. To be noted that, in the present embodiment, the shape of the support rod 31 and the shape of the support tube 21 are not limited by the present disclosure. The shapes herein are exemplary only and do not limit the shapes thereof.

Exemplarily, the support tube 21 is quadrangular, the support rod 31 is cylindrical, and the receiving channel 211 is a circular channel. The tube channel 42 includes a circular channel and a quadrangular channel communicated with the circular channel. In this way, the sleeve tube 41 can sleeve the support tube 21 through the quadrangular channel, and the sleeve tube 41 and the support tube 21 may not rotate relative to each other. The support rod 31 may be inserted into the receiving channel 211 by passing through the circular channel.

In the present embodiment, the fastening hole 43 is communicated to the first channel 421 and/or the second channel 422, such that it is ensured that the fastening portion 401 passes through the fastening hole 43 firstly, and subsequently, passes through the first channel 421 and/or the second channel 422 to abut against the support rod 31 and/or the support tube 21.

In other embodiments, in order to increase the fastening function of the positioning fastener 40, the support rod 31 and/or the support tube 21 may define a plurality of holes or slots in which the positioning fastener 40 can be received. The positioning fastener 40 may be inserted different holes in the support rod 31 and/or the support tube 21 to adjust the relative positions between the support rod 31 and the support tube 21.

By arranging the sleeve tube 41, fastening support strength of a fastening bolt can be improved, such that a damage caused by insufficient support strength between the fastening bolt and the support tube 21, due to the support tube 21 being excessively thin, can be avoided. When in use, when a height of the board bracket 30 relative to the lower support 20 needs to be adjusted, the fastening bolt is firstly threaded outwardly by a certain distance, and then the support rod 31 is moved upwardly or downwardly by a predetermined distance inside the receiving channel 211. Subsequently, the fastening bolt is moved inwardly by a certain distance to abut against an outer wall of the support rod 31 and is further threaded to fasten the support rod 31 to the support tube 21. In an embodiment, in order to enable the entire jigsaw puzzle table 100 to be moved, four universal wheels 23 having self-locking switches are mounted at a bottom of the lower support 20.

Exemplarily, in an embodiment, the lower support 20 is arranged with a first crossbeam 24. The board bracket 30 is arranged with a second crossbeam 35. By arranging first crossbeams 24 and second crossbeams 35 at opposite sides of the jigsaw puzzle table 100, overall strength and stability of the jigsaw puzzle table 100 is improved, and the jigsaw puzzle table 100 may not be collapsed after being used for a long period of time. One first crossbeam 24 connects at least two support tubes 21 to increase strength of the lower support 20. One second crossbeam 35 connects at least two support rods 31 of the board bracket 30 to increase strength of the board bracket 30.

Exemplarily, the first crossbeam 24 is located at a side of the lower support 20 near the board bracket 30, and the second crossbeam 35 is located at a side of the board bracket 30 near the lower support 20. In this way, strength of a position where the lower support 20 is connected to the board bracket 30 is improved. In addition, during the lower support 20 and the board bracket 30 are movably connected to each other, the first crossbeam 24 and the second crossbeam 35 increase the stability of the connection therebetween and limit, to some extent, a moving range of the lower support 20 and the board bracket 30, such that the lower support 20 and the board bracket 30 are movable within a predetermined range.

Exemplarily, in the present embodiment, the positioning fastener 40 is a fastening bolt, and the lower support 20 defines a thread hole (not shown) correspondingly. When in use, the fastening bolt is threaded to move inwardly or outwardly. When the fastening bolt is threaded to move inwardly to abut against the outer wall of the board bracket 30, the fastening is achieved. When the fastening bolt is threaded to move outwardly to leave the board bracket 30, the fastening is released. In this case, the board bracket 30 is moved up and down to adjust the support height.

In another embodiment, the positioning fastener 40 is a pin. In this case, the support tube 21 of the lower support 20 defines a pair of insertion holes. The support rod 31 of the board bracket 30 defines a plurality of pairs of insertion holes, and the plurality of pairs of insertion holes are equidistantly spaced apart from each other. The pin passes through the pair of insertion holes in the support tube 21 and one pairs of insertion holes in the support rod 31, such that the height is adjusted with multiple gradients.

In other embodiments, the positioning fastener 40 may be configured as other structures, as long as the lower support 20 and the board bracket 30 can be fastened with and detached apart from each other. the present disclosure does not limit detailed structure of the positioning fastener 40.

When the movable connection is the threaded connection, the lower support 20 is arranged with an externally-threaded tube, the board bracket 30 is arranged with an externally-threaded tube, and adjacent externally-threaded tubes are connected to each other by an internally-threaded tube sleeve. In this way, when the support height is adjusted, a relative height difference between the lower support 20 and the board bracket 30 can be changed by threading the internally-threaded tube sleeve, such that the support height formed by the lower support 20 and the board bracket 30 can be adjusted. When the movable connection is the telescopic-driving connection, a telescopic drive cylinder is mounted on the lower support 20, and a telescopic rod on the telescopic drive cylinder is connected to the board bracket 30. The telescopic drive cylinder drives the board bracket 30 to move up and down to change the support height. When the movable connection is splicing connection, each of the lower support 20 and the board bracket 30 is formed by splicing a plurality of blocks. Each block defines a rod hole in which a rod is inserted. In this way, the support height is adjusted by the lower support 20 and rod insertion.

In the present embodiment, the lower support 20 may be a one-piece frame, and the board bracket 30 may be a one-piece frame. In this way, heights of two sides of the board bracket 30 can be adjusted synchronously. In other embodiments, the lower support 20 may be formed by a plurality of support assemblies assembled to each other, and the board bracket 30 may be formed by a plurality of bracket assemblies assembled to each other. The plurality of support assemblies and the plurality of bracket assemblies may be connected in one-to-one correspondence to each other to form a plurality of support surfaces at a plurality of sides. In this way, the support height of one side or support heights of the plurality of sides can be adjusted based on demands. When there is a difference in heights of different support surfaces, the puzzle board 50 is tilted at an angle relative to the horizontal plane.

Exemplarily, the puzzle board 50 includes a puzzle carrying board 52, a support board 51, and a movable support member 53. The puzzle carrying board 52 is arranged above the support board 51. The movable support member 53 is disposed between the puzzle carrying board 52 and the support board 51. The puzzle carrying board 52 is switchable, by the movable support member 53, between a state in which the puzzle carrying board 52 is placed flat on the support plate 51 and a state in which the puzzle carrying board 52 is tilted to have an angle with respect to the support plate 51.

One end of the puzzle carrying board 52 is hinged to one end of the support board 51, forming a hinged portion. The movable support member 53 is disposed below a portion of the puzzle carrying board 52 away from the hinged portion. Specifically, one end of the movable support member 53 is hingedly connected to the puzzle carrying board 52 or the support board 51.

Figure 3:
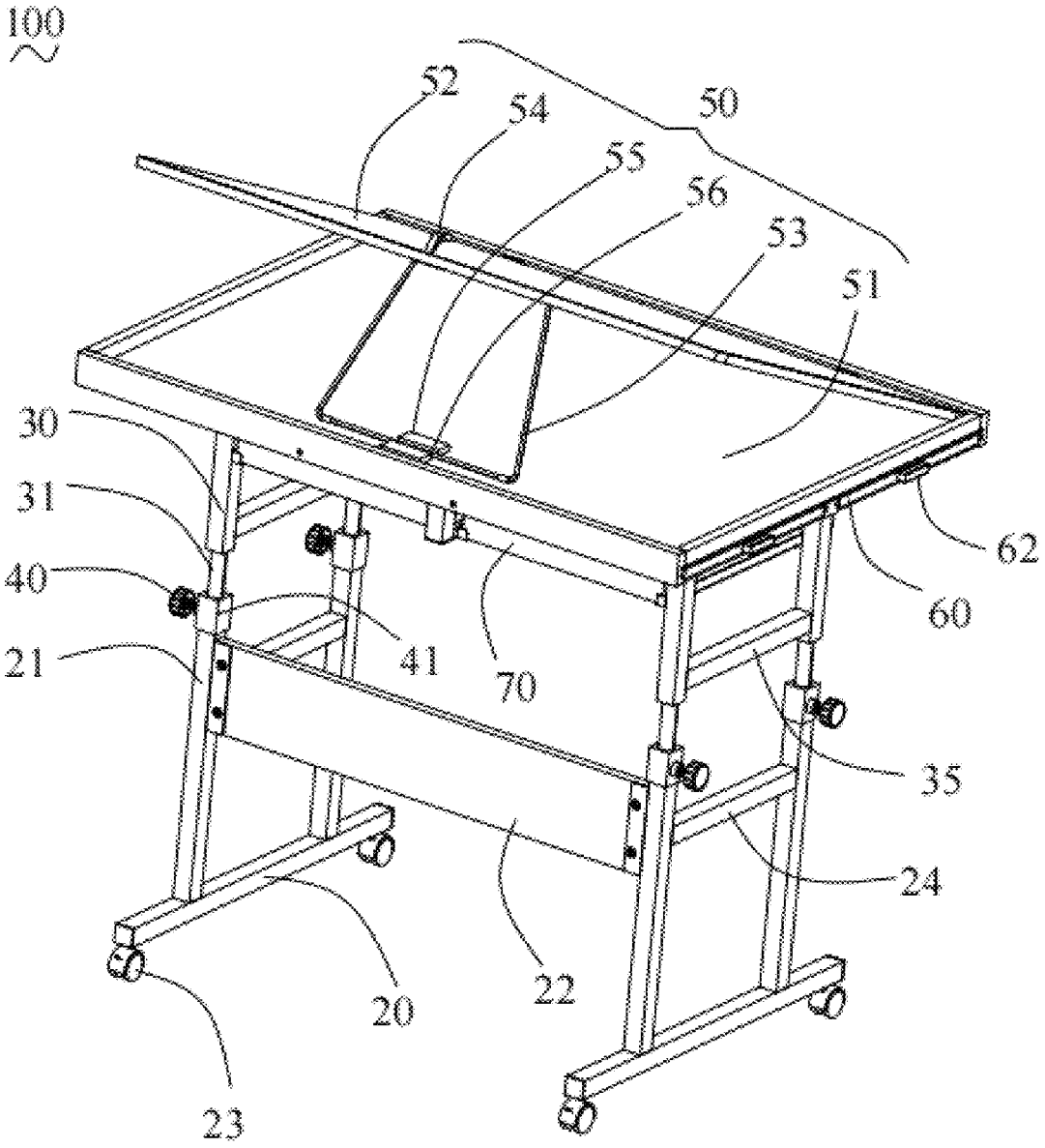
FIG. 3 is a schematic view of the jigsaw puzzle table shown in FIG. 2 being in use.
Figure 4:
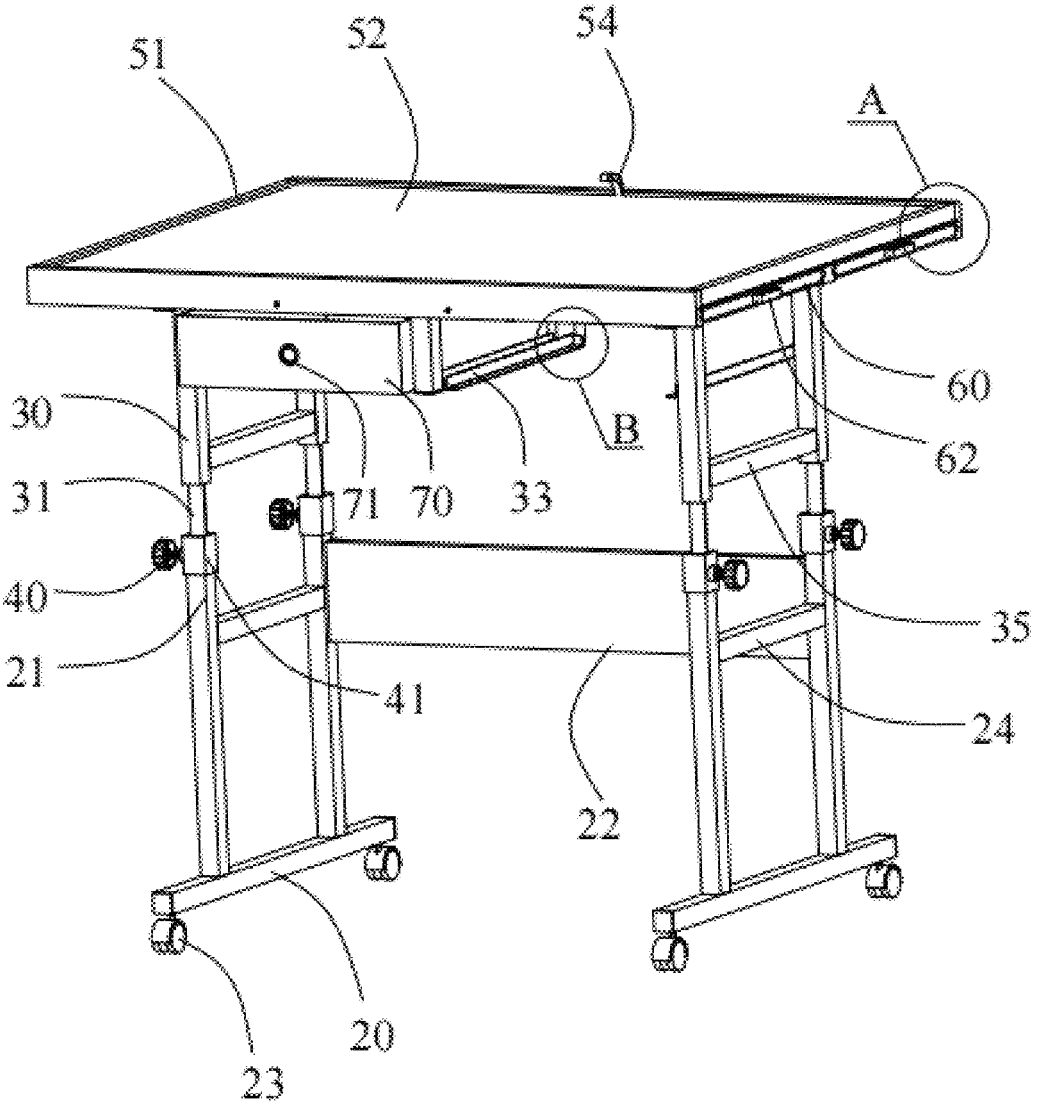
FIG. 4. is a schematic view of the jigsaw puzzle table shown in FIG. 1 having a second storage portion omitted.

Exemplarily, as shown in FIG. 3, in the present embodiment, one end of the movable support member 53 is hinged to the puzzle carrying board 52. A carrying handle 54 is mounted on a top surface of the puzzle carrying board 52. The carrying handle 54 is disposed on an end of the puzzle carrying board 52 away from the hinged portion. Further, the support plate 51 is arranged with two oppositely disposed limiting strips 55. The two limiting strips 55 cooperatively define a limiting slot 56. The movable support member 53 is adapted to the limiting slot 56. When in use, the carrying handle 54 is held by a hand of the user, and the puzzle carrying board 52 is pulled upwardly from the support plate 51. Subsequently, the movable support member 53 at the bottom of the puzzle carrying board 52 may swing at a certain angle to enable an end portion thereof to be received in the limiting slot 56. In this way, the puzzle carrying board 52 is tilted at a certain angle, and the user may play with jigsaw puzzle pieces.

In other embodiments, an end of the movable support member 53 is hinged with the support plate 51. Two oppositely disposed limiting strips are mounted on a bottom surface of the puzzle carrying board 52. When in use, the other end of the movable support member 53 is received between the two limiting strips and is limited by the two limiting strips.

In other embodiments, the puzzle carrying board 52 abuts against the support plate 51. In this case, the movable support member 53 may be an inclined support stage, and a height thereof is adjustable. In this way, the movable support member 53 may be placed on the support plate 51 to abut against the bottom surface of the puzzle carrying board 52, such that the puzzle carrying board 52 is inclined with respect to the support plate 51.

Exemplarily, the jigsaw puzzle table 100 further includes at least one first storage member 60 and/or at least one second storage member 70. The first storage member 60 is movably mounted below a puzzle surface of the puzzle board 50. The first storage member 60 is movable relative to the puzzle board 50 to be opened or closed. The second storage member 70 is movably mounted below the puzzle surface of the puzzle board 50. The second storage member 70 is movable relative to the puzzle board 50 to be opened or closed. Further, a storage cavity size of the first storage member 60 is different from a storage cavity size of the second storage member 70. The first storage member 60 and the second storage member 70 are mounted at different sides of the puzzle board 50. In the present embodiment, a depth of the storage cavity of the second storage member 70 is greater, and therefore, puzzle pieces in a larger size and a larger thickness can be stored in the second storage member 70. In the present embodiment, the first storage member 60 and the second storage member 70 are disposed below the puzzle board 50. In other embodiments, the first storage member 60, the second storage member 70 may be mounted on the puzzle board 50 when a thickness of the puzzle board 50 is large enough, and in this case, the first storage member 60 and the second storage member 70 are located in a cavity below the puzzle surface of the puzzle board 50.

The puzzle surface of the puzzle board 50 refers to a surface away from the lower support 20, or a surface on which the user splices the puzzle pieces.

Exemplarily, the first storage member 60 is located above the second storage member 70. The first storage member 60 is mounted on a side (a short edge) of the puzzle board 50, and the second storage member 70 is mounted on a front (a long edge) of the puzzle board 50. Specifically, a height of the first storage member 60 along a height direction of the puzzle board 50 is greater than a height of the second storage member 70. In this way, the first storage member 60 and the second storage member 70 are disposed at different planes and do not collide each other when being moved. Specifically, to avoid the collision, a bottom surface of the first storage member 60 is higher than a top surface of the second storage member 70.

It should also be noted that, in the present embodiment, the depth of the second storage member 70 disposed on the front of the puzzle board 50 is configured to be greater than the depth of the first storage member 60 disposed on the side of the puzzle board 50. In this way, collision between the second storage member 70 and the first storage member 60, when being moved, is reduced, and in addition, items can be stored therein. It is understood that a length of the front of the puzzle board 50 is greater than a length of the side of the puzzle board 50. In other words, the length of the long edge of the puzzle board 50 is greater than the length of the short edge of the puzzle board 50. In practice, a frequency that the user faces the front of the puzzle board 50 to splice puzzle pieces is higher a frequency that the user faces the size of the puzzle board 50 to splice puzzle pieces. Furthermore, since the length of the side is smaller than the length of the front, more users may face the front of the puzzle board 50 to splice puzzle pieces. Therefore, by considering various factors, the depth of the second storage member 70 disposed at the front of the puzzle board 50 is greater than the depth of the first storage member 60 disposed at the size of the puzzle board 50. Therefore, the user may store or take out items conveniently. More specifically, the first storage member 60 disposed on the side of the puzzle board 50 means that the first storage member 60 may be pulled out of the puzzle board 50 from a short edge of the puzzle board 50, and the second storage member 70 disposed on the front of the puzzle board 50 means that the second storage member 70 may be pulled out of the puzzle board 50 from a longer edge of the puzzle board 50.

Exemplarily, the board bracket 30 defines at least one set of sliding slots 32 and/or at least one set of support retaining edges 33. The first storage member 60 is slidably connected to the sliding slots 32, and the second storage member 70 is slidably connected to the support retaining edges 33. In this way, the first storage member 60 may slide along the sliding slots 32, and the second storage member 70 may slide along the support retaining edges 33. Therefore, the sliding is guided and stable.

Exemplarily, as shown in FIGS. 1 to 5, 10 and 12, the jigsaw puzzle table 100 further includes at least one first storage member 60 mounted on a side end of the board bracket 30. The board bracket 30 defines at least one set of sliding slots 32, and the first storage member 60 is arranged with slide rails 61 adapted to the sliding slots 32, and the slide rails 61 are mounted on two sides of the first storage member 60. In this way, the first storage member 60 may slide smoothly along the sliding slots 32. In order to facilitate the first storage member 60 to be pulled out and received in the board bracket, the first storage member 60 is arranged with a pulling block 62. In the present embodiment, four first storage members 60 are arranged, and four sets of sliding slots 32 are defined. Two of the four first storage members 60 are located on one side of the board bracket 30, and the other two of the four first storage members 60 are located on the other side of the board bracket 30. In this way, four pullable storage regions are formed, puzzle pieces in smaller sizes and smaller thicknesses ca be stored.

Exemplarily, as shown in FIGS. 4, 5, 11, and 13, the jigsaw puzzle table 100 further includes at least one second storage member 70 mounted on the board bracket 30. The second storage member 70 is disposed under the puzzle board 50. The board bracket 30 is arranged with at least one set of support retaining edges 33. Two side edges of the second storage member 70 abut against the support retaining edges 33, respectively. The second storage member 70 can be pulled under the support and the limitation of the support retaining edges 33. Further, an end of the second storage part 70 defines a pulling hole 71, and a limiting block 34 is arranged on each support retaining edge 33. The limiting block 34 is located on an end of the support retaining edge 33 away from the pulling hole 71. In this way, when in use, the finger may apply a pulling force to the pulling hole 71, which is quite convenient. The limiting block 34 ensures that the second storage member 70 is not be pushed in excessively far, and therefore, the second storage member 70 is prevented from sliding off from the support retaining edge 33. In the present embodiment, two second storage members 70 are arranged, and two sets of support retaining edges 33 are arranged. In this way, two pullable storage regions are formed, and puzzle pieces of larger size and larger thicknesses can be stored conveniently. In the present embodiment, a pair of bracket rods 36 are mounted at a bottom of the board bracket 30. The bracket rods 36 are configured to support the support retaining edges 33. Ends of the support retaining edges 33 are connected to the bracket rods 36, corresponding.

Figure 5:
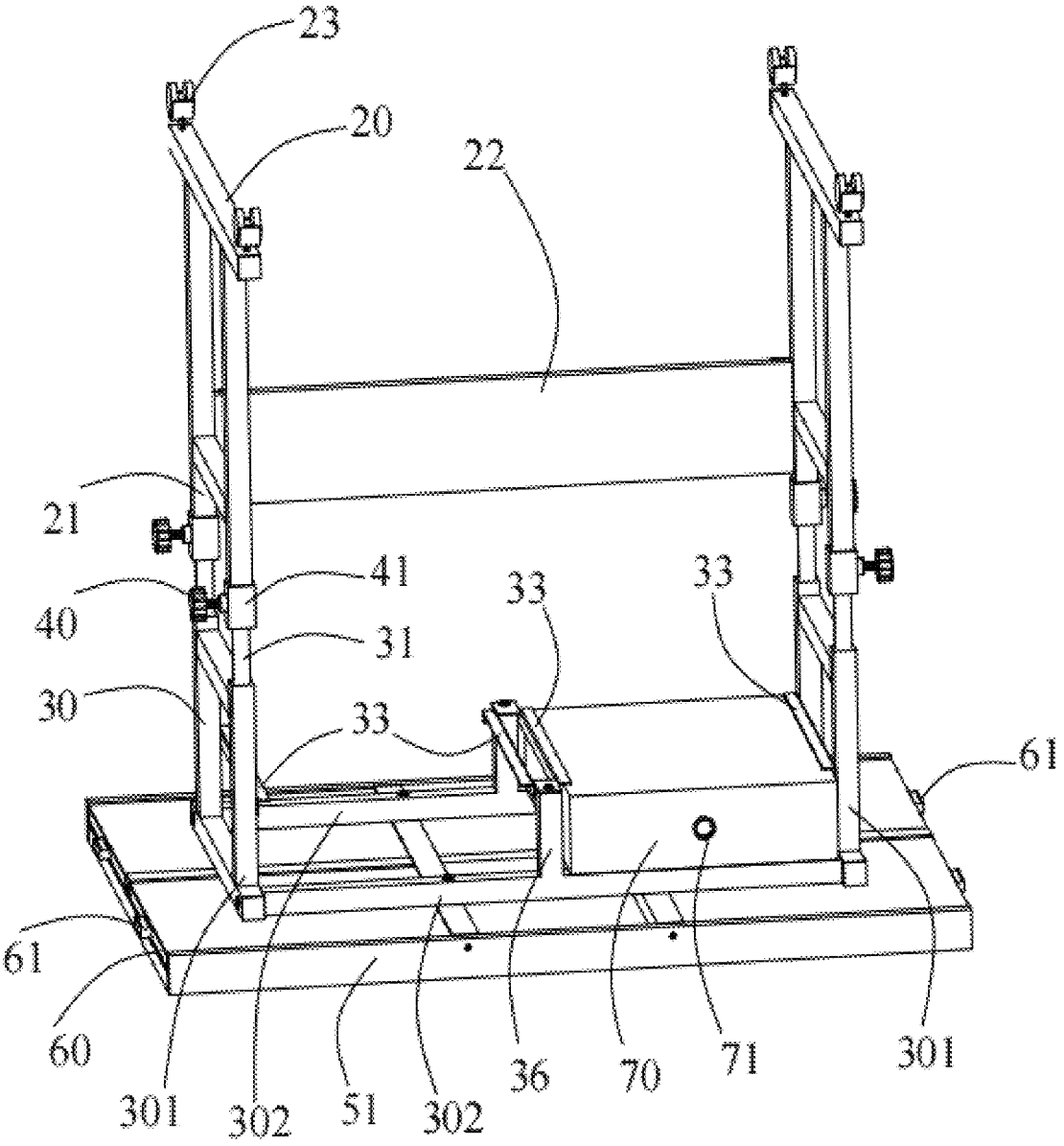
FIG. 5 is a schematic view of the jigsaw puzzle table shown in FIG. 4 being inverted.
Figure 6:
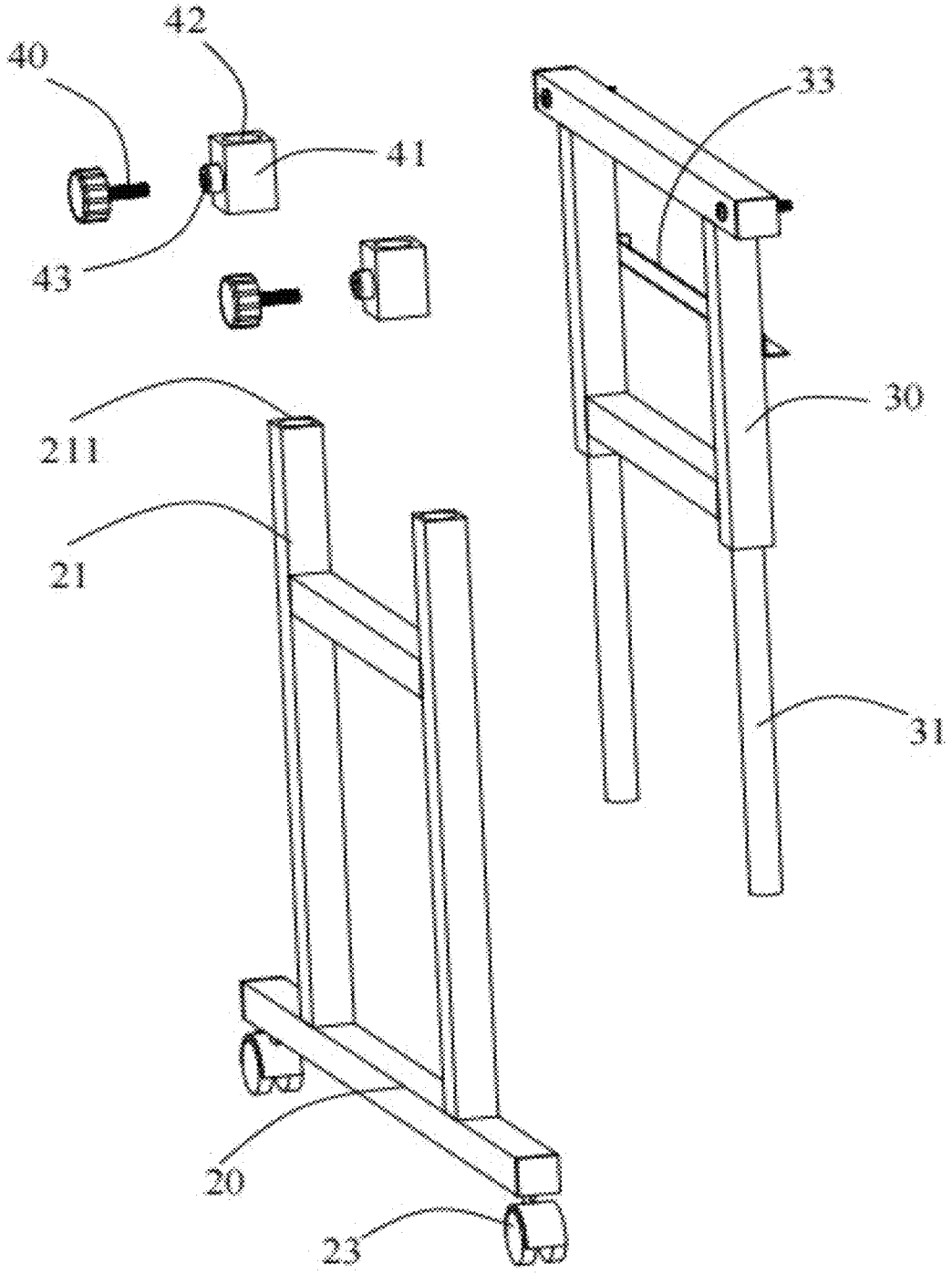
FIG. 6 is an exploded view of a board bracket and a lower support of the jigsaw puzzle table shown in FIG. 1.
Figure 7:
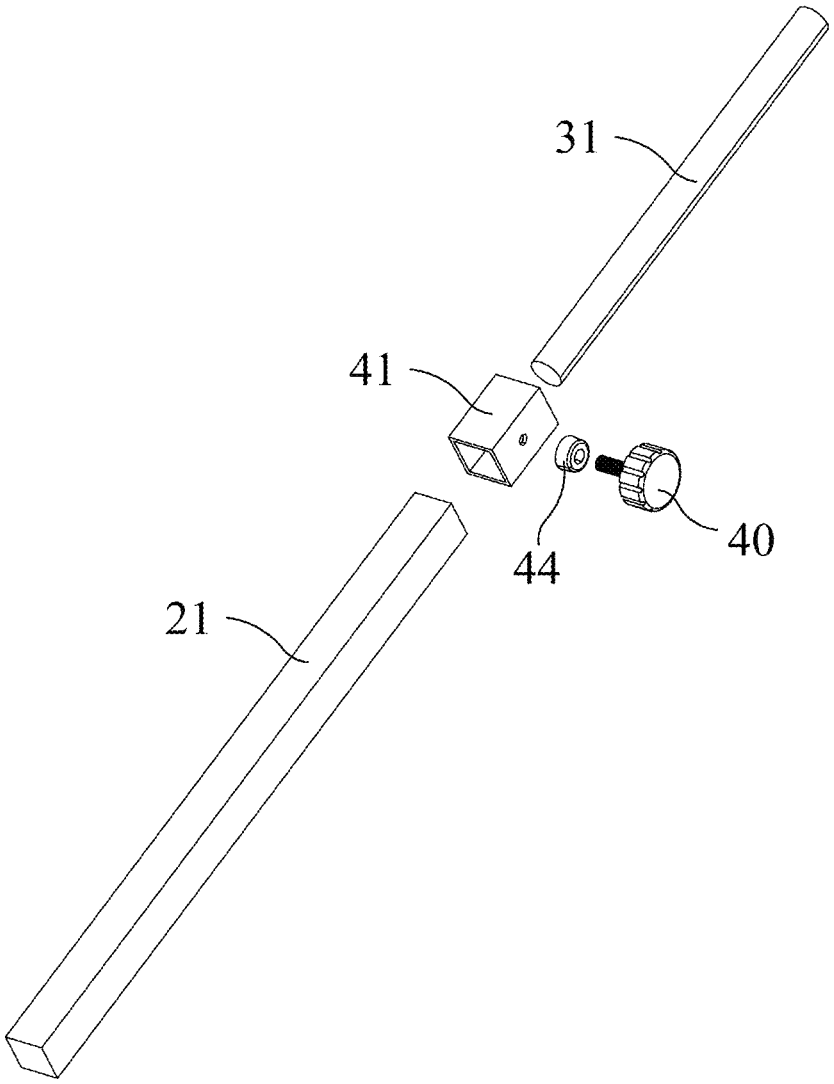
FIG. 7 is a schematic view of a support tube, a support rod, a positioning fastener, and a sleeve tube of the structure shown in FIG. 6.
Figure 8:
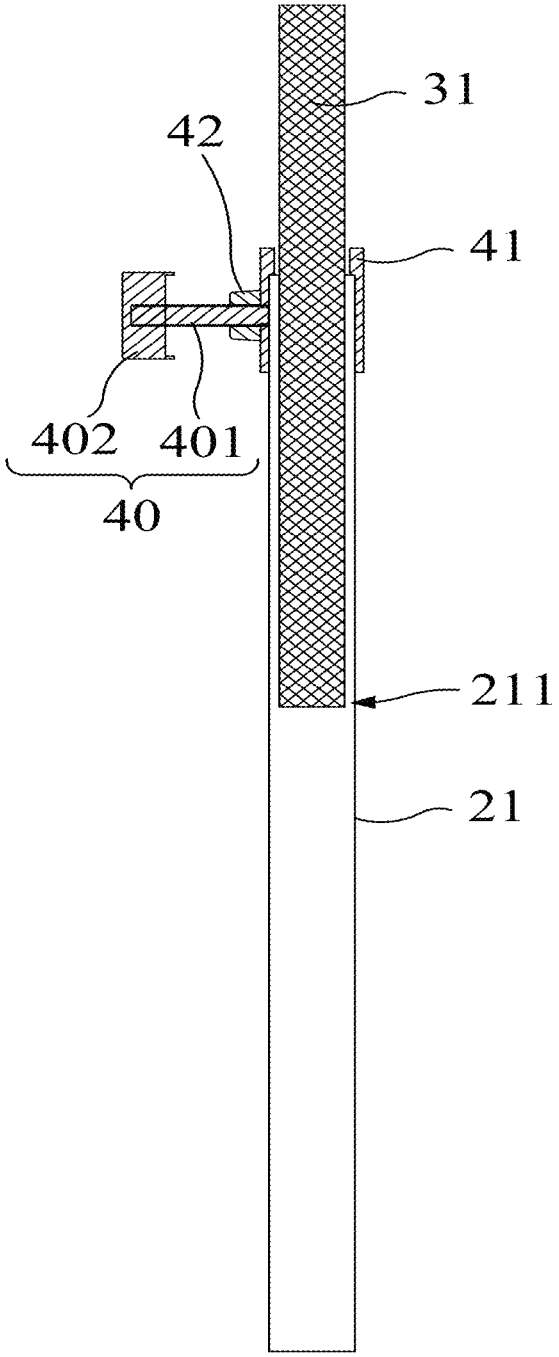
FIG. 8 is a cross-sectional view of the structures shown in FIG. 7 in a length direction, after being assembled to each other.
Figure 9:
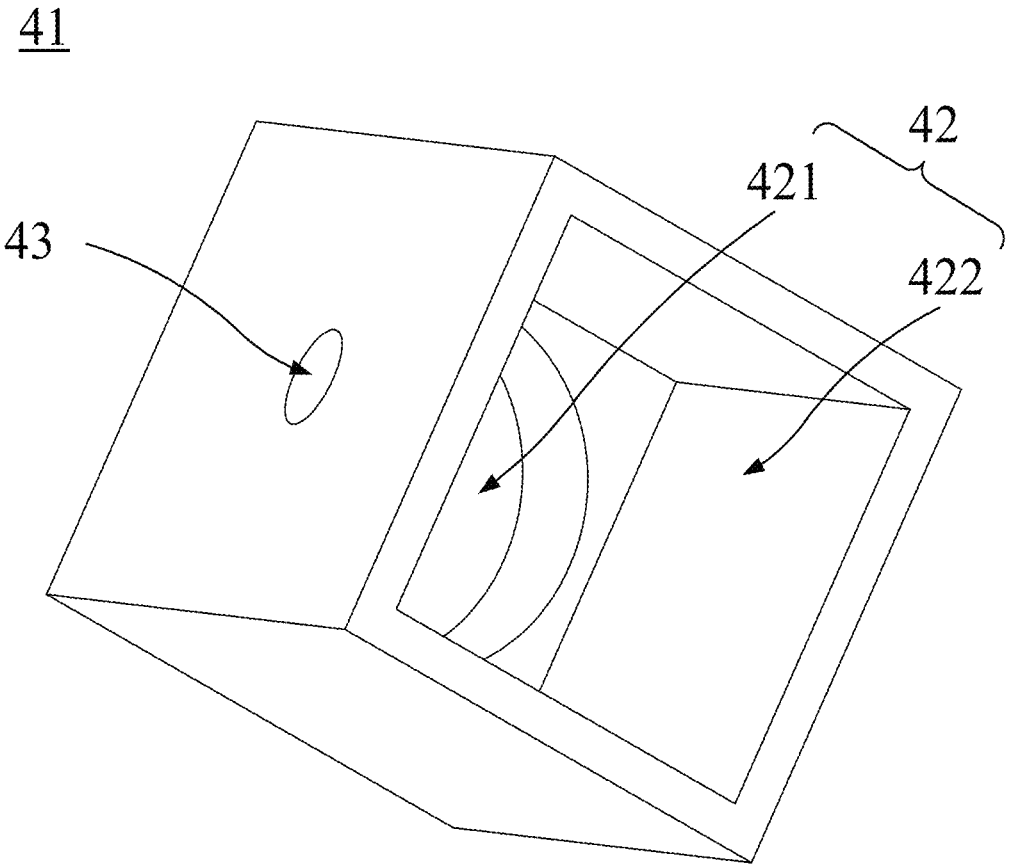
FIG. 9 is a schematic view of the sleeve tube shown in FIG. 7.
Figure 10:
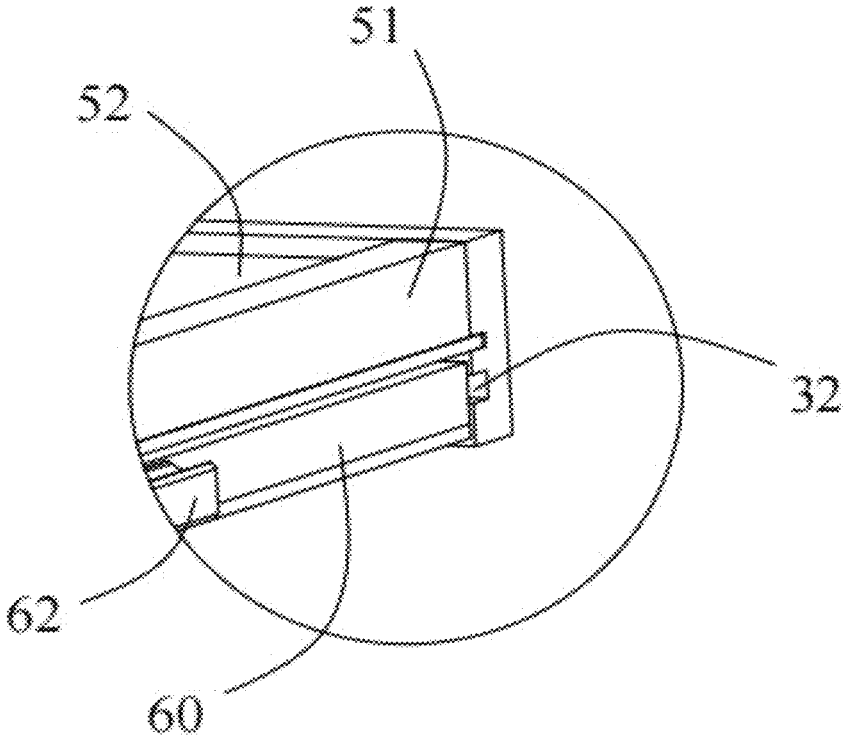
FIG. 10 is an enlarged view of the portion A shown in FIG. 4.
Figure 11:
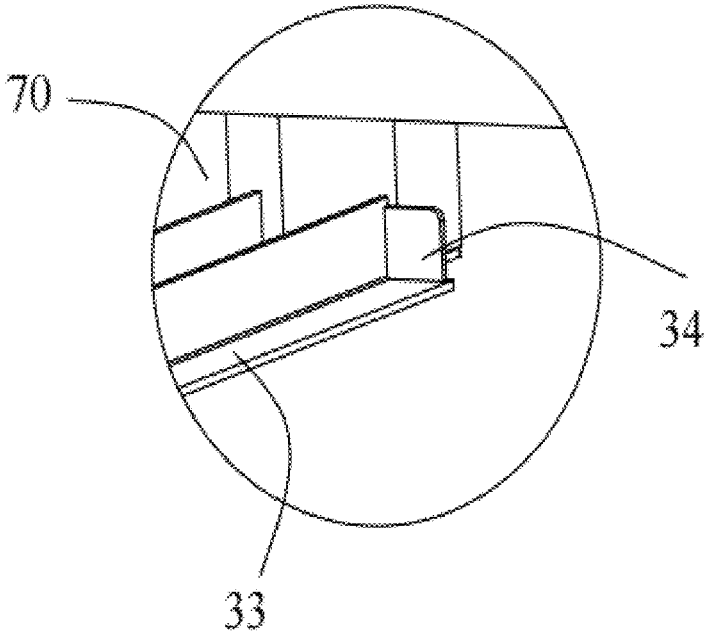
FIG. 11 is an enlarged view of the portion B shown in FIG. 4.
Figure 12:
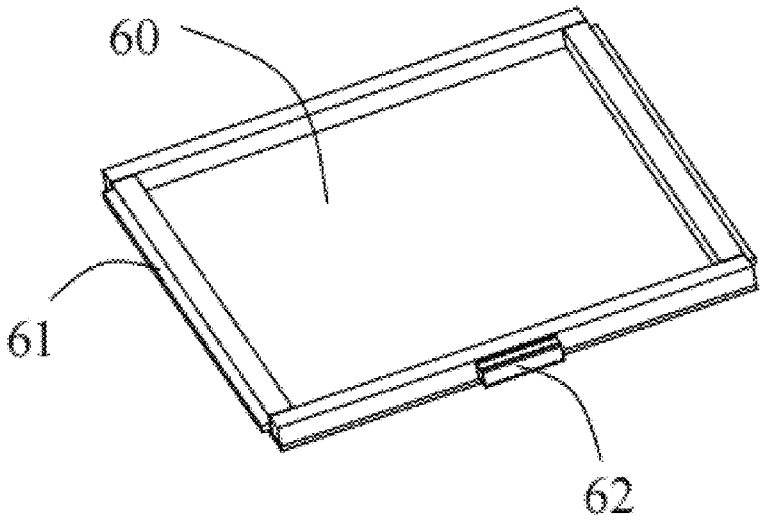
FIG. 12 is a schematic view of a first storage portion of the jigsaw puzzle table shown in FIG. 1.
Figure 13:
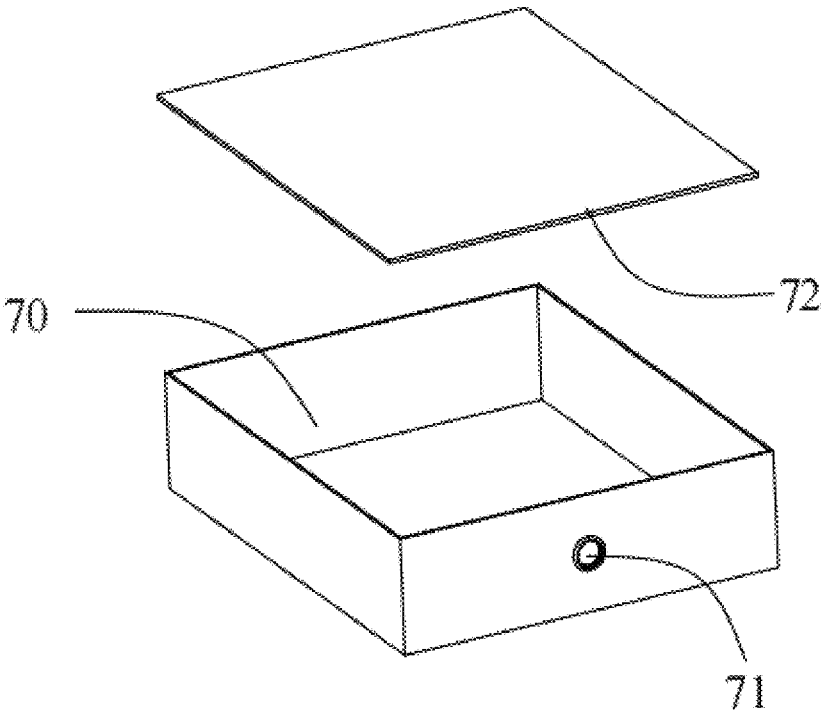
FIG. 13 is a schematic view of a second storage portion of the jigsaw puzzle table shown in FIG. 1.

As shown in FIG. 5, the board bracket 30 includes two oppositely disposed side end portions 301 and two crossbar portions 302. The above-mentioned support rods 31 are disposed at bottoms of the side end portions 301 extending downwardly. End portions of the two crossbar portions 302 are respectively connected to the corresponding side end portions 301. In the present embodiment, the bracket rods 36 extend vertically downwardly from bottoms of the crossbar portions 302. The bracket rods 36 and the crossbar portions 302 may be connected to each other by bonding or welding, or the bracket rods 36 and the crossbar portions 302 may be integrally molded to form a one-piece structure, which will not be limited herein. Each bracket rod 36 is located at a middle between the two side end portions 301. In this way, forces are more uniformly distributed, and the bracket rods 36 provide a better lifting and supporting effect. Two support retaining edges 33 are mounted between the two bracket rods 36 and are opposite to each other. Each side end portion 301 is arranged with one support retaining edge 33 at a side near the bracket rods 36. In this way, a side of the second storage member 70 is disposed on the support retaining edge 33 arranged on the bracket rods 36, and the other side of the second storage member 70 is disposed on the support retaining edge 33 arranged on the side end portion.

Figure 14:
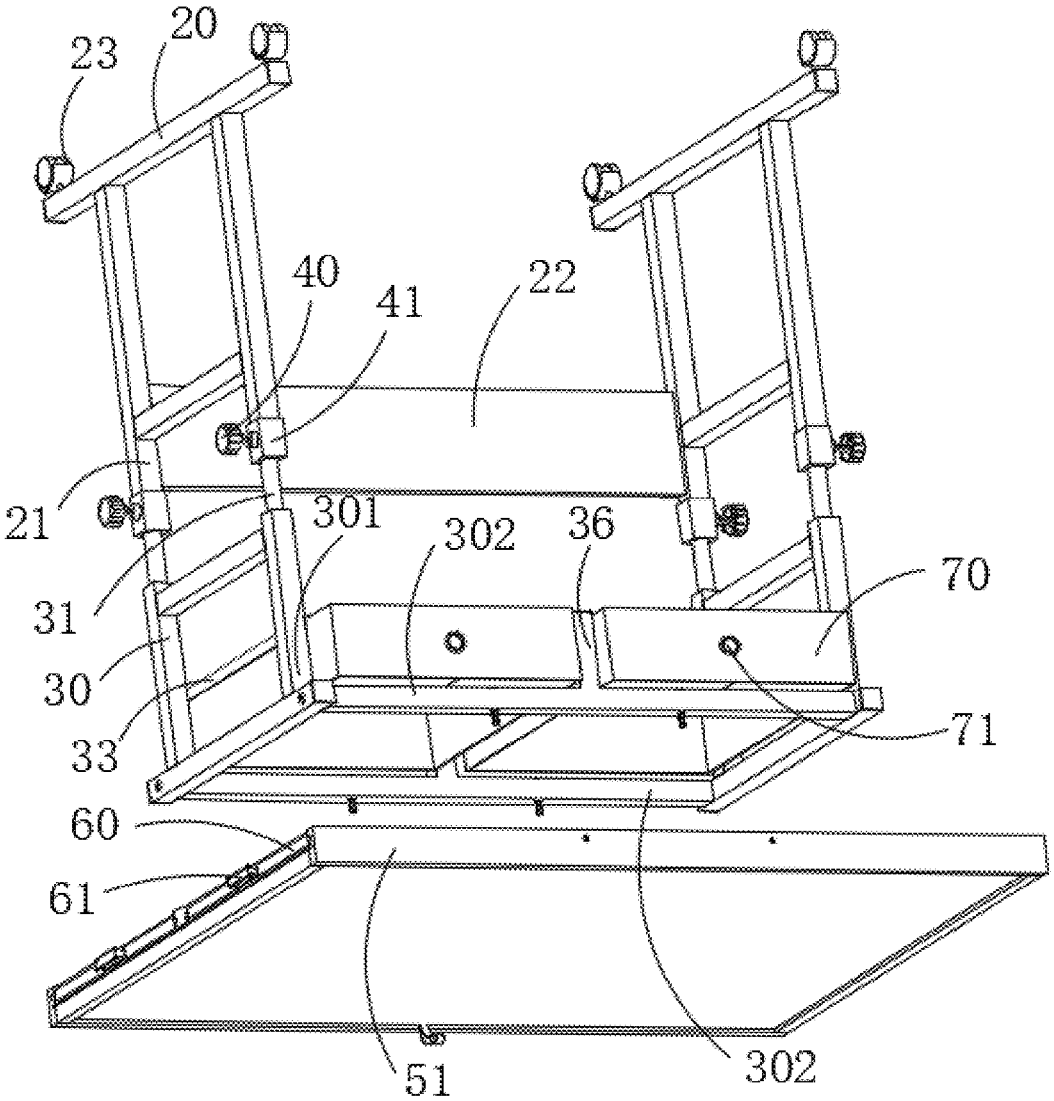
FIG. 14 is an exploded view of the board bracket and the lower support shown in FIG. 1.
Figure 15:
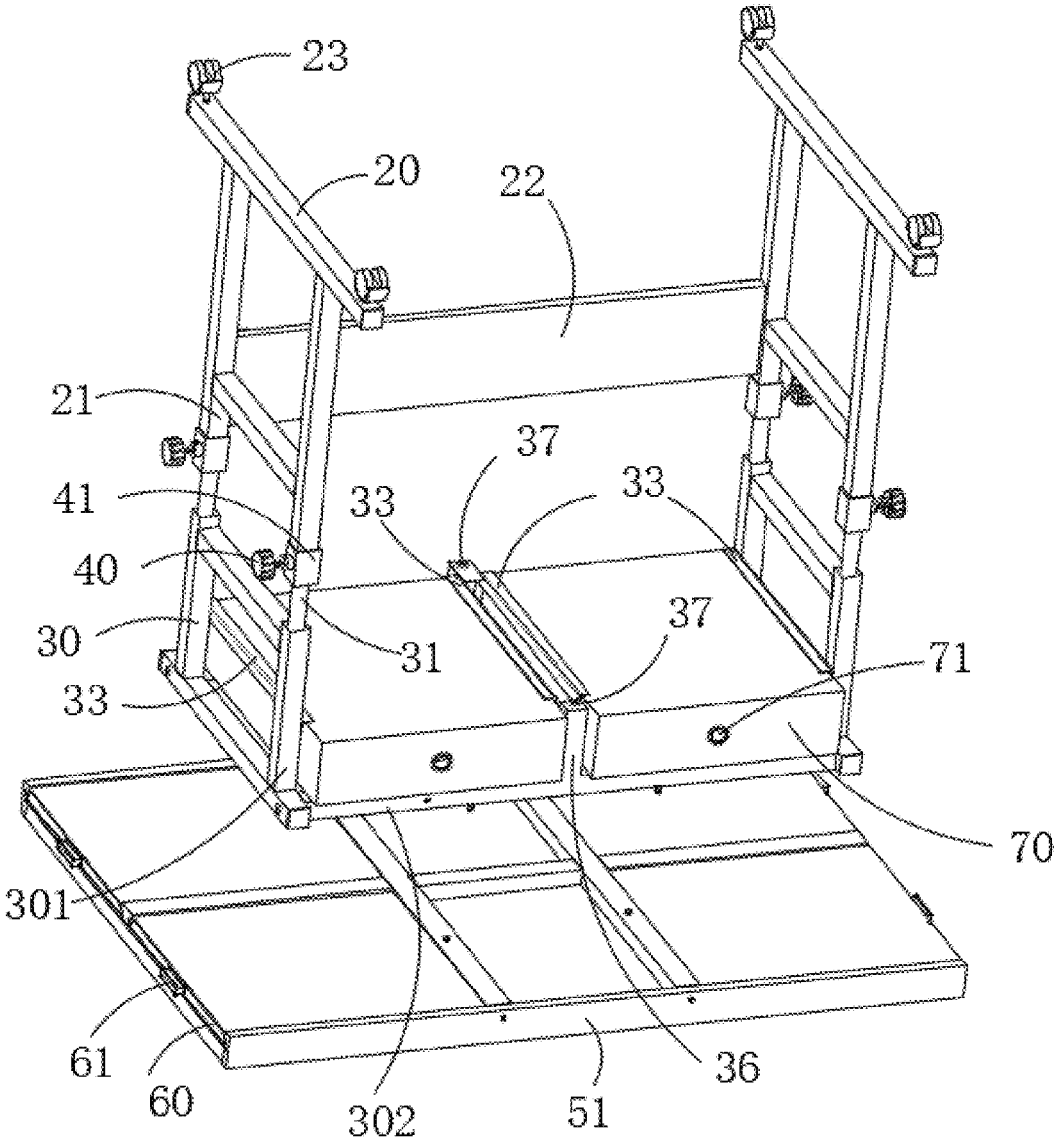
FIG. 15 is another exploded view of the board bracket and the lower support shown in FIG. 1.

FIG. 14 and FIG. 15 further show exploded view of the board bracket and the lower support. In particular, the support retaining edge 33 is connected to the bracket rod 36 via a screw 37. For example, an end of the support retaining edge 33 near the pulling hole 71 of the second storage member 70 is connected to the bracket rod 36 through a screw 37, and the other end of the support retaining edge 33 away from the pulling hole 71 of the second storage member 70 is connected to the bracket rod 36 through another screw 37.

In another embodiment, a second storage cover 72 is further arranged for the second storage member 70. The second storage cover 72 is configured to cover the second storage member 70 when the second storage member 70 is removed from the board bracket 30 and used as a storage box.

According to the above-described jigsaw puzzle table 100, since the board bracket 30 is mounted between the puzzle board 50 and the lower support 20. The lower support 20 and the board bracket 30 cooperatively support the puzzle board 50. The lower support 20 and the board bracket 30 are movably connected to each other so as to adjust the support height at at least one side of two sides. When in use, when the user feels uncomfortable and needs to adjust the height, the player only needs to adjust the positional relationship between the lower support 20 and the board bracket 30 at one or more sides, such that the support height formed between the lower support 20 and the board bracket 30 is adjusted, and a comfortable height for the user is reached. The height of the jigsaw puzzle table 100 can be adjusted according to the height of the user, and a better usage experience is provided.

Various technical features of the above-described embodiments can be combined arbitrarily. In order to make the description concise, not all possible combinations of the various technical features are described. However, as long as no contradiction occurs, any combination thereof should be included in the scope of the present disclosure.

The above-described embodiments show only several embodiments of the present disclosure, which are described in a more specific and detailed manner, but shall not be interpreted as a limitation of the scope of the present disclosure. To be noted that, any ordinary skilled person in the art may perform various deformations and improvements without departing from the concept of the present disclosure, all of which shall fall within the scope of the present disclosure. Therefore, the scope of the present disclosure shall be subject to the appended claims.

What is claimed is:

1. A jigsaw puzzle table, comprising:

a puzzle board;

a board bracket, wherein the puzzle board is mounted on a mounting end of the board bracket; and a lower support, wherein the board bracket is mounted between the puzzle board and the lower support, the board bracket and the lower support are configured to support the puzzle board cooperatively, the board bracket and the lower support are movably connected to each other;

a positioning fastener, connected to at least one of the board bracket and the lower support, wherein the positioning fastener is configured to secure the board bracket and the lower support to fix a height of the puzzle board supported by the board bracket and the lower support; the positioning fastener is further configured to release the security between the board bracket and the lower support to enable the board bracket and the lower support to be at least partially movable relative to each other to adjust the supported height;

wherein the board bracket comprises support rods supporting the puzzle board, each of the support rods is sleeved in a respective support tube of the lower support; the jigsaw puzzle table further comprises a sleeve tube that sleeves an outside of the support rod that is exposed out of the support tube, and an outside of a portion of the support tube that sleeves the support rod; the positioning fastener is connected to the sleeve tube to fasten the support rod with the support tube.

2. The jigsaw puzzle table according to claim 1, further comprising at least one first storage member, wherein, each first storage member is movably mounted below a puzzle surface of the puzzle board, the first storage member is movable relative to the puzzle board to be opened or closed.

3. The jigsaw puzzle table according to claim 2, further comprising at least one second storage member, wherein, each second storage member is movably mounted below the puzzle surface of the puzzle board, the second storage member is movable relative to the puzzle board to be opened or closed.

4. The jigsaw puzzle table according to claim 3, wherein, a storage cavity size of the first storage member is different from a storage cavity size of the second storage member; and the first storage member and the second storage member are mounted at different sides of the puzzle board.

5. The jigsaw puzzle table according to claim 4, wherein, a depth of the storage cavity size of the second storage member is larger than a depth of the storage cavity size of the first storage member.

6. The jigsaw puzzle table according to claim 3, wherein, the first storage member is located above the second storage member, the first storage member is mounted at a side of the puzzle board, and the second storage member is mounted at a front of the puzzle board.

7. The jigsaw puzzle table according to claim 6, wherein, the first storage member is configured to be pulled out of the puzzle board from a short edge of the puzzle board, and the second storage member is configured to be pulled out of the puzzle board from a longer edge of the puzzle board.

8. The jigsaw puzzle table according to claim 3, wherein, the puzzle board is arranged with at least one set of sliding slots, each first storage member is slidably connected to a respective one set of sliding slots.

9. The jigsaw puzzle table according to claim 8, wherein the puzzle board is arranged with at least one set of support retaining edges, and each second storage member is slidably connected to a respective one set of support retaining edges.

10. The jigsaw puzzle table according to claim 9, wherein, each second storage member has an end face that is capable of being operated by a user to pull the second storage member out of the puzzle board, each support retaining edge is arranged with a limiting block at an end of the support retaining edge away from the end face of the second storage member, and the limiting block is configured to prevent the second storage member from moving further inside into the puzzle board.

11. The jigsaw puzzle table according to claim 10, wherein the board bracket comprises two oppositely arranged side end portions and two oppositely arranged crossbar portions, the two oppositely arranged crossbar portions are connected between the two oppositely arranged side end portions, the two side end portions and the two crossbar portions cooperatively support the puzzle board.

12. The jigsaw puzzle table according to claim 11, wherein, the board bracket further comprises two bracket rods extending from the two crossbar portions respectively away from the puzzle board.

13. The jigsaw puzzle table according to claim 12, wherein the at least one set of support retaining edges are arranged on the two bracket rods and the side end portions correspondingly.

14. The jigsaw puzzle table according to claim 1, further comprising at least one first storage member and at least one second storage member, wherein, each of the at least one first storage member is movably mounted below the puzzle board; each of the at least one second storage member is movably mounted below the at least one first storage member; a bottom surface of each of the at least one first storage member is above a top surface of each of the at least one second storage member; the first storage member and the second storage member are arranged at different planes; each of the at least one first storage member is movable along a first direction; each of the at least one second storage member is movable along a second direction that is substantially perpendicular to the first direction.

15. The jigsaw puzzle table according to claim 14, wherein, in a height direction of the jigsaw puzzle table, a bottom surface of the first storage member is higher than a top surface of the second storage member.

16. The jigsaw puzzle table according to claim 1, wherein, the puzzle board comprises a puzzle carrying board, a support board and a movable support member; the puzzle carrying board is disposed above the support board, the movable support member is disposed between the puzzle carrying board and the support board; the puzzle carrying board is switchable, by the movable support member, between a state in which the puzzle carrying board is placed flat on the support board and another state in which the puzzle carrying board is inclined at an angle with respect to the support board.

17. The jigsaw puzzle table according to claim 1, wherein, the positioning fastener comprises a fastening portion and an operating portion, the fastening portion is connected to the operating portion, the sleeve tube defines a fastening hole, the fastening portion is mounted in the fastening hole.

18. The jigsaw puzzle table according to claim 1, wherein, the sleeve tube defines a first channel and a second channel communicated with the first channel, a shape of the first channel is adapted to a shape of an outer surface of the support rod, and a shape of the second channel is adapted to a shape of an outer surface of the support tube.

19. The jigsaw puzzle table according to claim 18, wherein, a size of the second channel is not less than a size of the first channel, and the support rod passes through the second channel.

* * * * *